US005816851A

United States Patent [19]

Cheng et al.

[11] Patent Number: 5,816,851

[45] Date of Patent: Oct. 6, 1998

[54] DEVICE FOR SHORT-CIRCUITING FOR USE WITH CONNECTOR

[75] Inventors: Lee-Ming Cheng, Cupertino, Calif.; I-Fee Chen, Chung-Li, Taiwan; Gwou-Jong Tseng, Tu-Chen, Taiwan; Yuh Huey Kang, Pan-Chiao, Taiwan; George Lee, Taipei, Taiwan

[73] Assignee: Hon Hai Precision Ind. Co., Ltd., Taipei Hsien, Taiwan

[21] Appl. No.: 760,170

[22] Filed: Dec. 4, 1996

Related U.S. Application Data

[63] Continuation-in-part of Ser. No. 405,236, Mar. 16, 1995, Pat. No. 5,609,493.

[51] Int. Cl.[6] ..... H01R 31/08

[52] U.S. Cl. ..... 439/510

[58] Field of Search ..... 439/507–514

[56] References Cited

U.S. PATENT DOCUMENTS

| | | | |
|---|---|---|---|
| 4,252,396 | 2/1981 | Wilson | 439/499 |
| 4,659,158 | 4/1987 | Sakamoto et al. | 439/507 |
| 4,973,273 | 11/1990 | DePriest | 439/856 |
| 5,000,699 | 3/1991 | Nadin | 439/507 |
| 5,334,053 | 8/1994 | Noschese | 439/682 |
| 5,609,493 | 3/1997 | Cheng et al. | 439/378 |

*Primary Examiner*—Neil Abrams

[57] ABSTRACT

A shorting block (10) includes a main body (12) defining a plurality of passageways (14) therein. A conductive strip (22) including a plurality of downward extending tangs (24) adapted to be received within the corresponding passageways (14), respectively, is attached to the main body (12) from the top. A cover (28) including a pair of locking tabs (30) positioned at two opposite ends, is fastened to the main housing (12) and has the conductive strip (22) sandwiched therebetween. An offset area (36) is formed on the top surface (26) of the main body (12) for snugly receiving the conductive strip (22) therein. Each of some passageways (14) further includes a guidable alignment post (15) for aligning and pre-loading the inserted tang (24) therewith.

8 Claims, 8 Drawing Sheets

DEVICE FOR SHORT-CIRCUITING FOR USE WITH CONNECTOR

This application is a continuation-in-part of the application of Ser. No. 08/405,236 filed Mar. 16, 1995, of which the specification is incorporated by reference into this specification. The Ser. No. 08/405,236 application has since been granted U.S. Pat. No. 5,609,493.

BACKGROUND OF THE INVENTION

1. Field of The Invention

The invention relates to a short-circuiting device for use with a connector, and particularly to the short-circuiting device having a simple and reliable structure thereof for assembling.

2. The Related Art

As shown in FIG. 1 the aforementioned copending parent application discloses a shorting block 1 including a main housing 2 defining a plurality of passageways 3. A conductive strip 4 includes a plurality of tangs 5 extending into the corresponding passageways 3 for engagement with the complementary pins of the connector (not shown) in which the shorting block 1 is received. A cover 6 is attached to the top of the main housing 2 so as to have the conductive strip 4 sandwiched therebetween for fastening the conductive strip 4 in position.

The cover 6 further includes a pair of alignment tabs 7 extending downward at two opposite ends and a pair of locking tabs 8 extending downward on end side edge for cooperatively securing the cover 6 to the main housing 2.

Because these securing devices seems somewhat redundant for the whole structures, it is desired to have a simpler but still reliable structure thereof for implementation of assembling of the shorting block.

SUMMARY OF THE INVENTION

According to an aspect of the invention, a shorting block includes a main body defining a plurality of passageways therein. A conductive strip including a plurality of downward extending tangs adapted to be received within the corresponding passageways, respectively, is attached to the main body from the top. A cover including a pair of locking tabs positioned at two opposite ends, is fastened to the main housing and has the conductive strip sandwiched therebetween. An offset area is formed on the top surface of the main body for snugly receiving the conductive strip therein. Each of some passageways further includes a guiding post for aligning and pre-loading the inserted tang therewith.

DETAILED DESCRIPTION OF THE PREFERRED EMBODIMENTS

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 7:
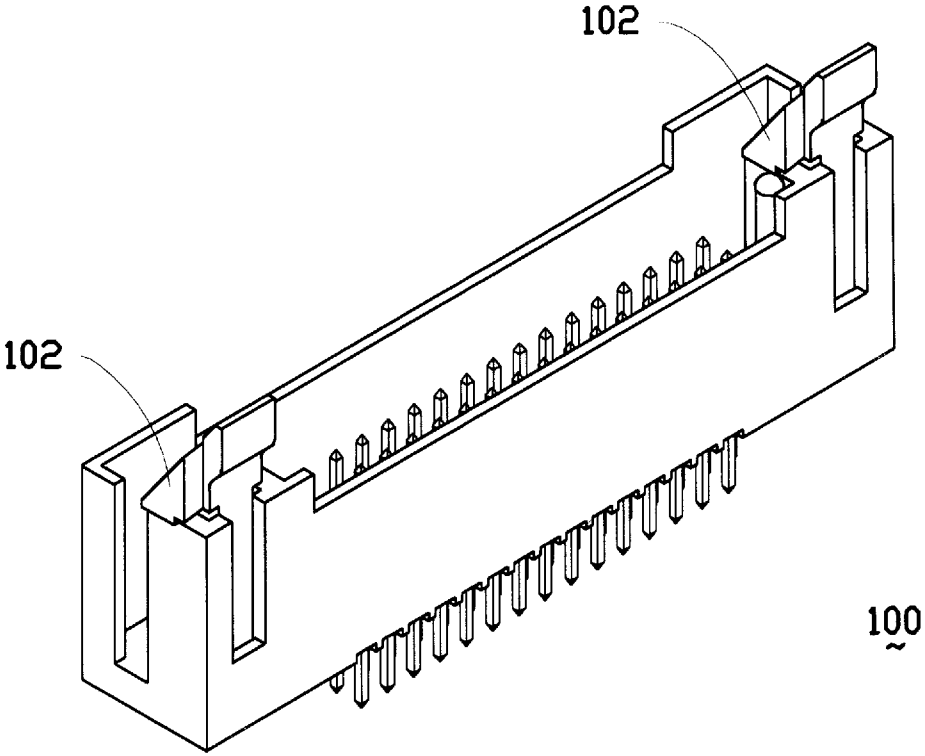
FIG. 7 is a perspective view of a header connector for use with the subject shorting block of FIG. 2.

It will be noted here that for a better understanding, most of like components are designated by like reference numerals throughout the various figures in the embodiments. Attention is directed to FIGS. 2–4, 7 and 8 wherein a shorting block 10 includes an insulative main body 12 defining a plurality of passageways 14 therein, and a board portion 16 aside such passageways. The board portion 16 includes a holding section 18 for manual grasping and a pair of latching sections 20 adjacent two opposite ends thereof for cooperation with the latches 102 of a header connector 100 (FIG. 7).

Figure 8:
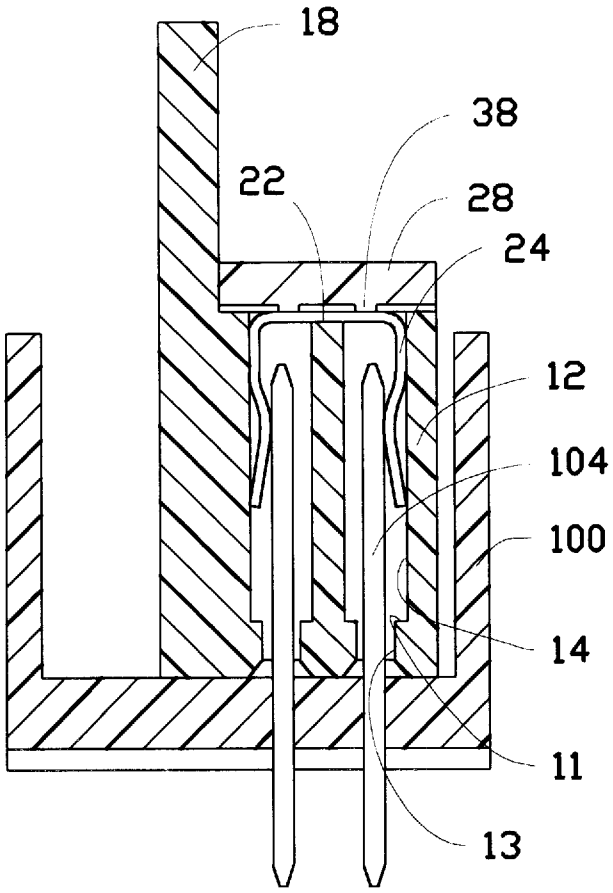
FIG. 8 is a cross-sectional view of the header connector of FIG. 7 with the shorting block of FIG. 2 therein.

A conductive strip 22 including a plurality of downward extending tangs 24, is adapted to be attached to the top surface 26 of the main body 12 wherein the tangs 24 are received in the corresponding passageways 14, respectively, for mechanical and electrical engagement with the pins 104 of the header connector 100 upward extending into the same corresponding passageways 14 (FIG. 8).

A cover 28 including two locking tabs 30 positioned at two opposite ends thereof, is adapted to be attached to the top surface 26 of the main body 12 and have the conductive strip 22 sandwiched therebetween, wherein the locking tabs 30 are engaged with the protrusions 32 formed on the ends walls 34 of the main body 12.

To assure the conductive strip 22 can be stably held between the cover 28 and the top surface 26 of the main body 12, an offset area 36 is formed on the top surface 26 of the main body in compliance with the contour of the conductive strip 22 to accommodate the conductive strip 22 therein. Moreover, ribs 38 are formed on the under-surface 40 of the cover 28 for abutment with the conductive strip 22.

Figure 1:
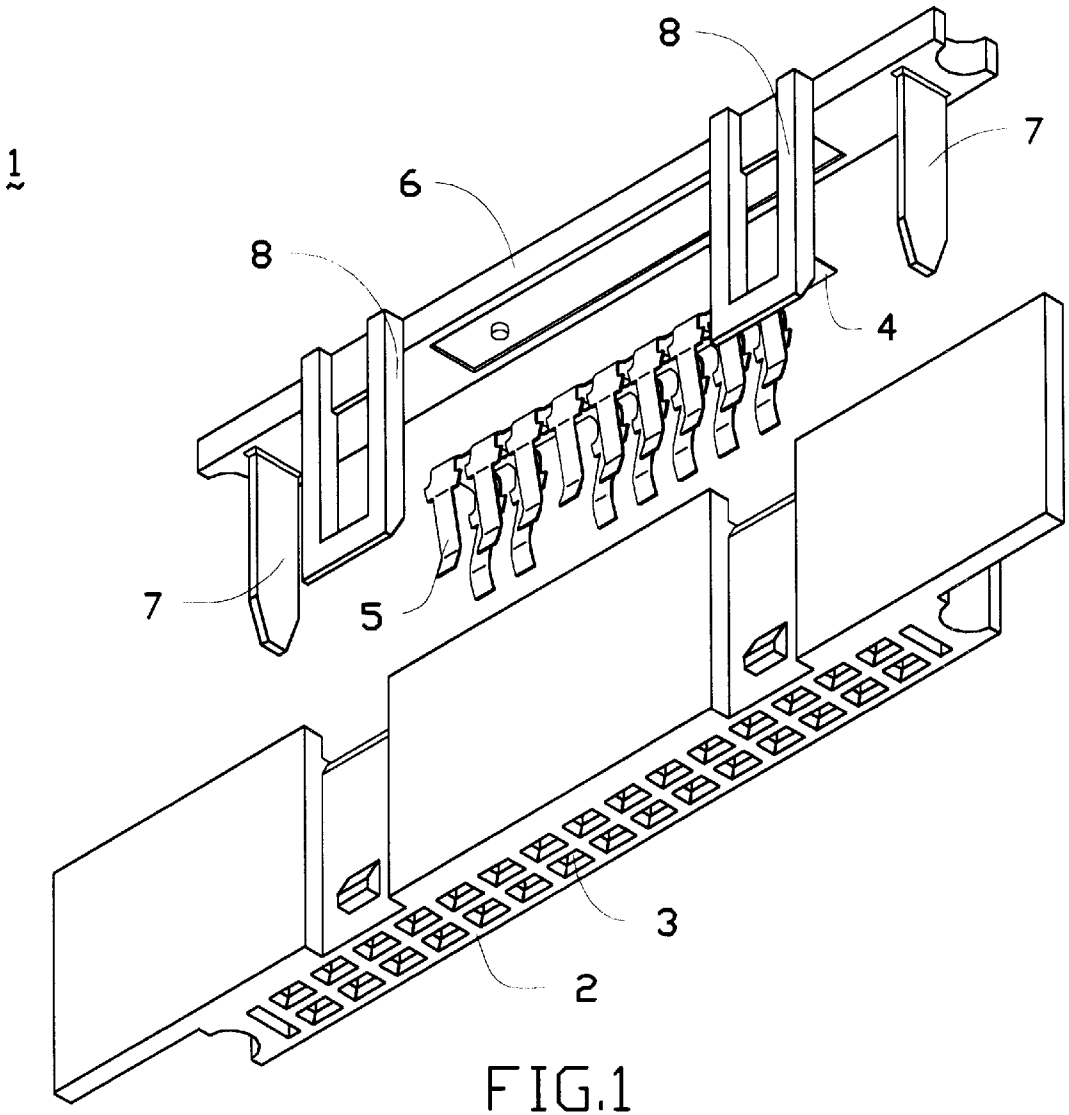
FIG. 1 is an exploded perspective view of a shorting block of the copending parent application.
Figure 2:
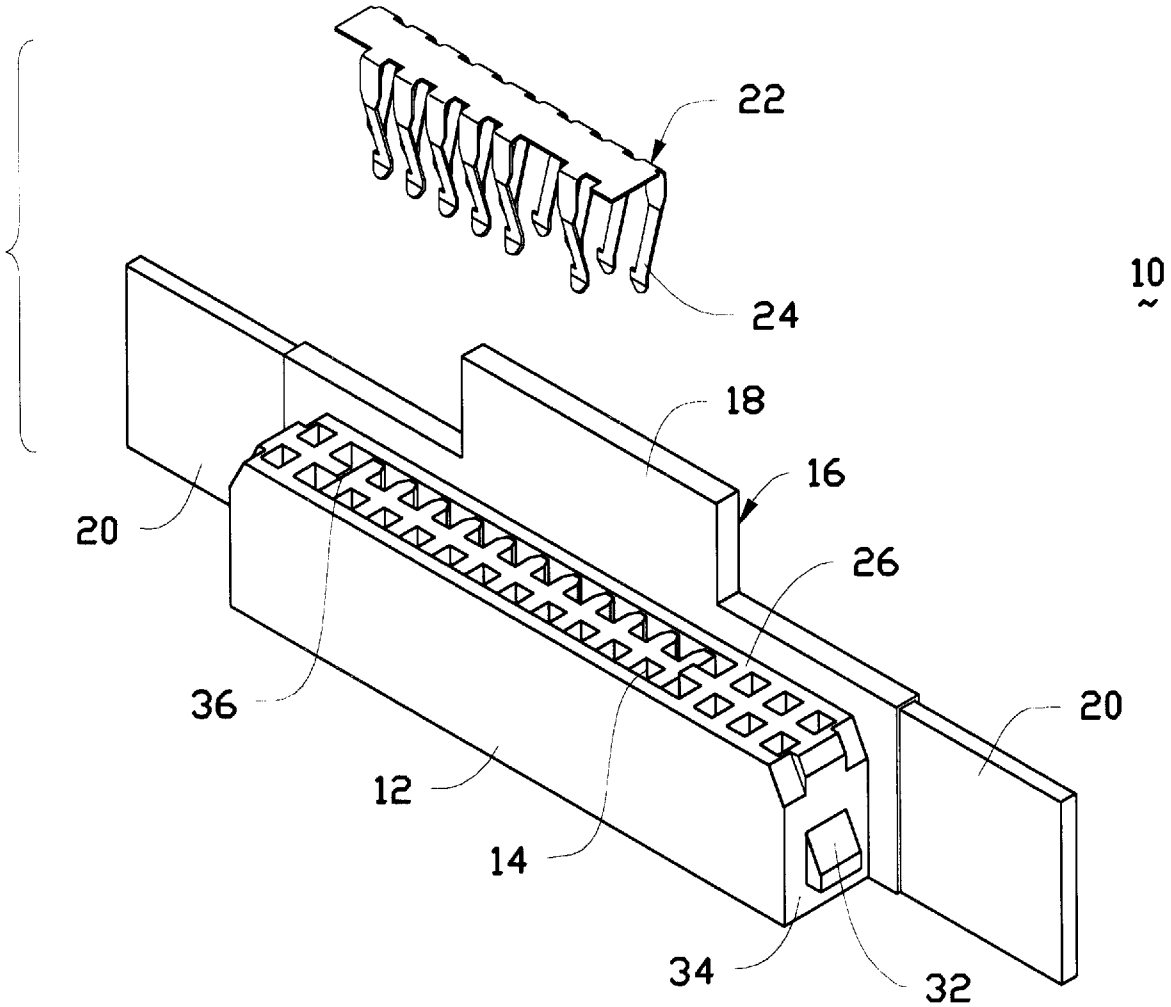
FIG. 2 is an exploded perspective view of the shorting block without the cover thereon, according to the invention.
Figure 3:
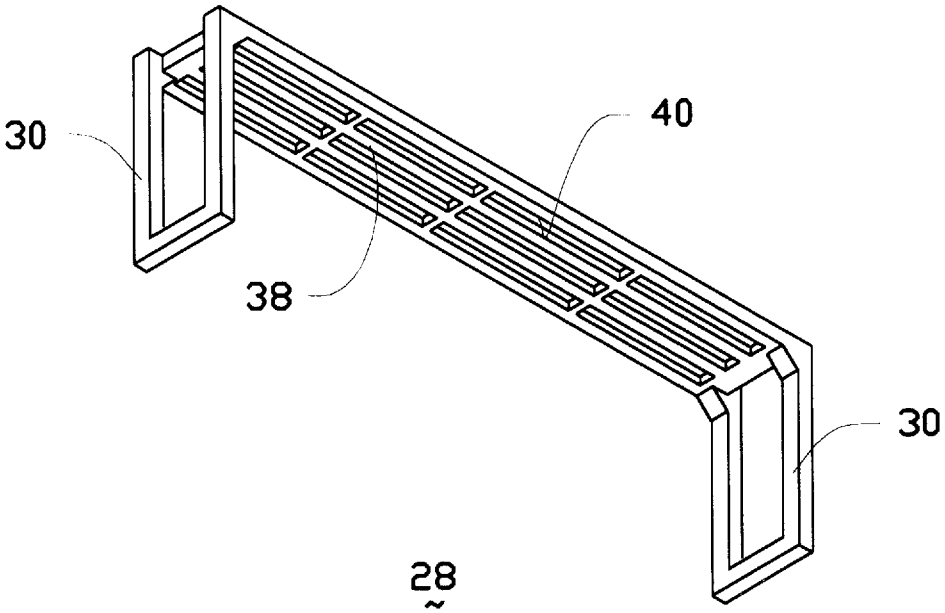
FIG. 3 is a perspective view of the cover for use with the shorting block of FIG. 2.
Figure 4:
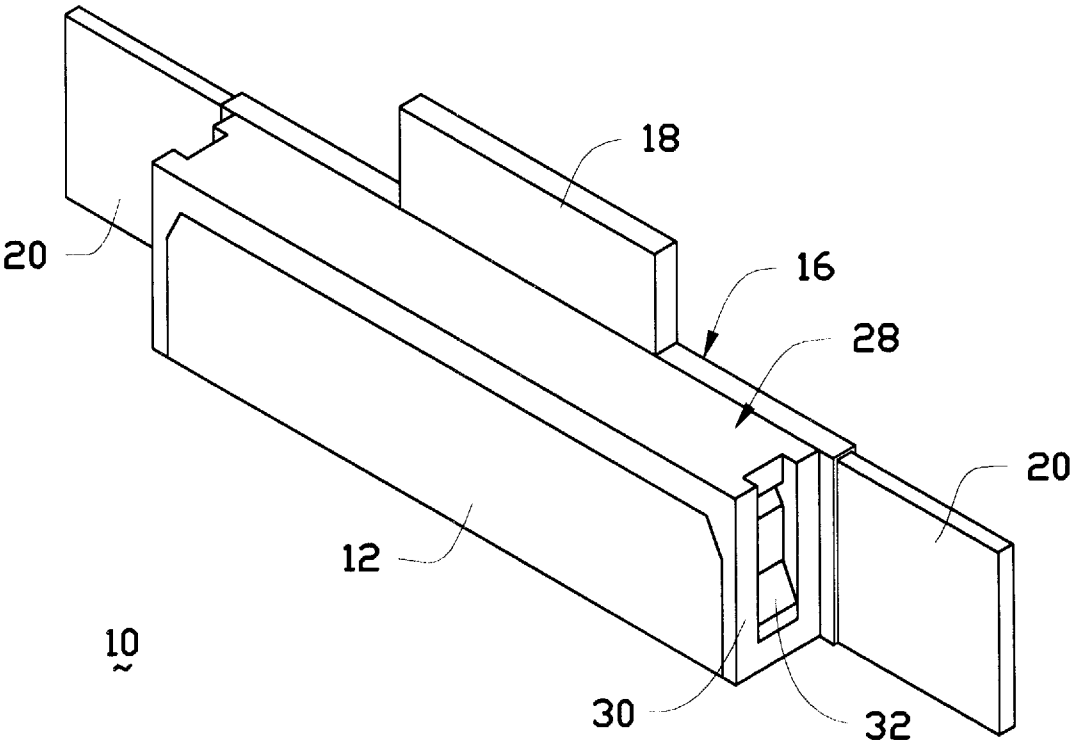
FIG. 4 is a perspective view of the assembled shorting block of FIG. 1.
Figure 5:
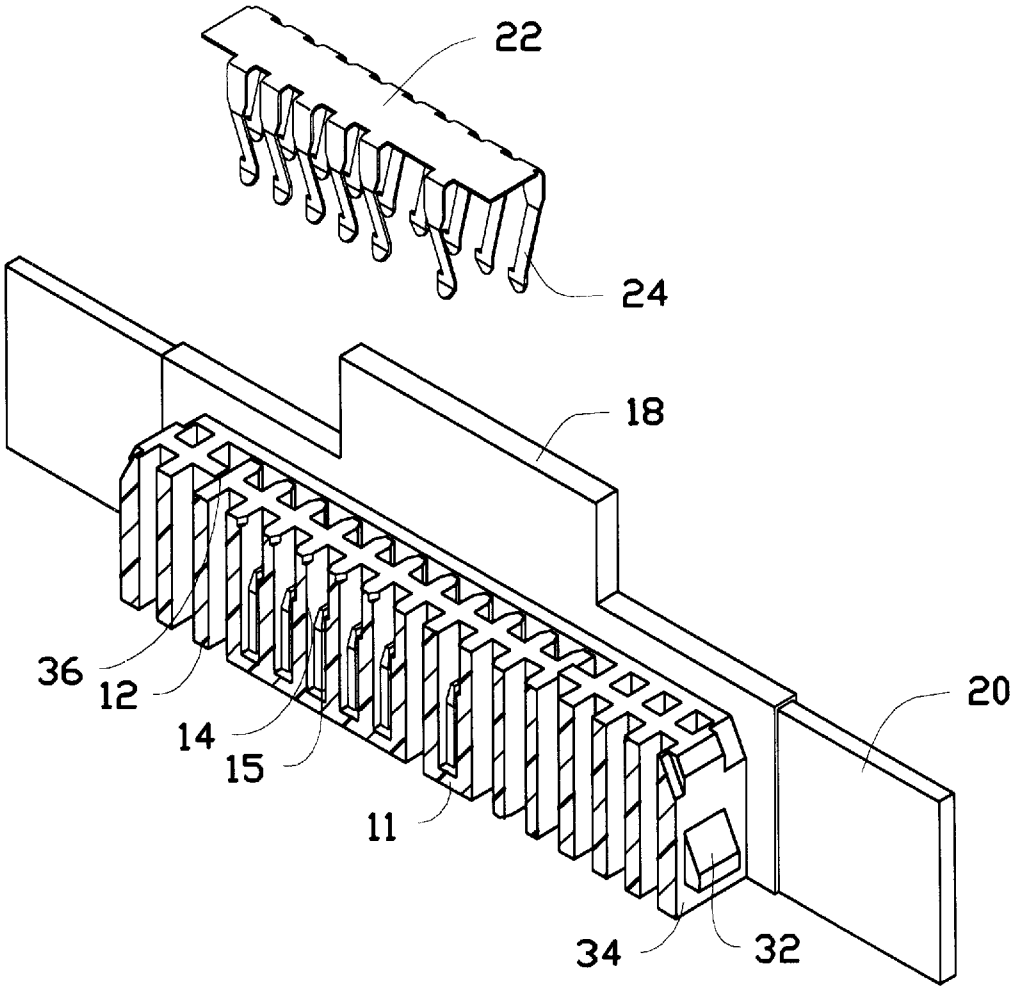
FIG. 5 is a fragmentary perspective view of the main body of the shorting block of FIG. 1 without the conductive strip thereon to show the alignment posts in some passageways.
Figure 6:
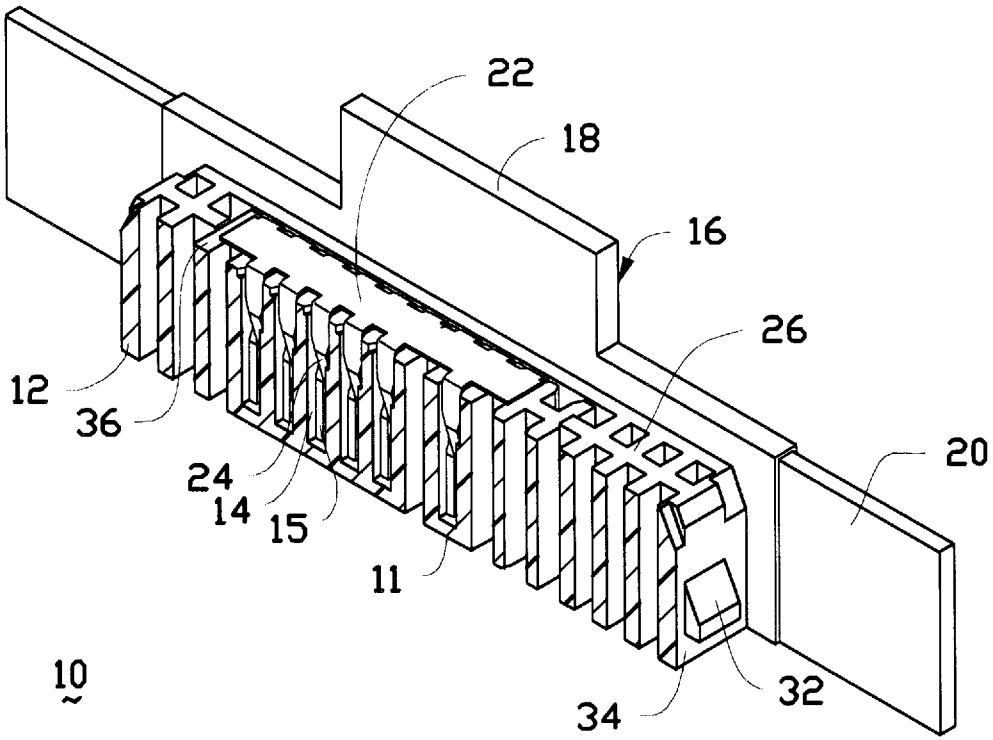
FIG. 6 is a fragmentary perspective view of the main body of the shorting block with the tangs of the conductive strip therein to show how the tangs engage with the corresponding alignment posts, respectively.

Referring to FIGS. 5 and 6, to ease installation of the downward extending tangs 24 of the conductive strip 22 within the corresponding passageways 14 of the main body 12, each of the corresponding passageway 14 includes an alignment post 15 on one corner whereby the downward extending tangs 24 can be guidably inserted into the corresponding passageway 14 and supportably engaged with the post 15 for performing a pre-loaded manner, thus easing insertion of the corresponding pins 104 of the connector 100 (FIGS. 7 and 8).

Moreover, referring to FIG. 8, each corresponding passageway 14 having the alignment post 15 therein, further includes a bottom wall 11 with a reduced dimensioned opening 13 in comparison with the other passageways 14 without such alignment posts 15. These smaller openings 13 can guide the inserted pins 104 of the connector 100 for properly engaging the corresponding tangs 24 of the conductive strip 22.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, person of ordinary skill in this field are to understand that all such equivalent structures are to be included within the scope of the following claims.

We claim:

1. A shorting block for use with a header connector having two locking latches at two opposite ends, comprising:

a main body defining a plurality of passageways therein;

a board integrally formed with the main body and including a holding section and two latching sections at two opposite ends;

a conductive strip adapted to be attached to a top surface of the main body, said conductive strip including a plurality of downward extending tangs adapted to be received within the corresponding passageways, respectively; and a cover adapted to be attached to the top surface of the main body for sandwiching the conductive strip therebetween, said cover including a pair of locking tabs at two opposite ends thereof for cooperation with a pair of protrusions formed on two opposite end walls of the main body.

2. The shorting block as defined claim 1, wherein each of some said passageways includes an alignment post therein for guiding the inserted tang of the conductive strip.

3. The shorting block as defined in claim 1, wherein ribs are formed on an under-surface of the cover for abutment with the conductive strip.

4. The shorting block as defined in claim 2, wherein each of said passageways having the alignment post therein, further includes a bottom wall with a reduced dimensioned opening for guidance of an inserted pin of said header connector.

5. A shorting block for use with a header connector having two locking latches at two opposite ends, comprising:

a main body defining a plurality of passageways therein;

a board integrally formed with the main body and including a holding section and two latching sections at two opposite ends;

a conductive strip adapted to be attached to a top surface of the main body, said conductive strip including a plurality of downward extending tangs adapted to be received within the corresponding passageways; and a cover adapted to be attached to the top surface of the main body for sandwiching the conductive strip therebetween, said cover including a pair of locking tabs at two opposite ends thereof for cooperation with a pair of protrusions formed on two opposite end walls of the main body, wherein an offset area is defined in the top surface of the main body for snugly receiving the conductive strip therein.

6. The shorting block as defined in claim 5, wherein some of said passageways include an alignment post therein for guiding the inserted tang of the conductive strip.

7. The shorting block as defined in claim 5, wherein ribs are formed on an under-surface of the cover for abutment with the conductive strip.

8. The shorting block as defined in claim 6, wherein each of said passageways having the alignment post therein further includes a bottom wall with an opening of reduced dimension for guiding an inserted pin of said header connector.

* * * * *